US005884391A

United States Patent [19]

McGuire et al.

[11] Patent Number: 5,884,391

[45] Date of Patent: Mar. 23, 1999

[54] PROCESS FOR MANUFACTURING AN ELECTRICAL DEVICE COMPRISING A PTC ELEMENT

[75] Inventors: Katherine M. McGuire, Clarendon Hills; Honorio Luciano, Elk Grove Village, both of Ill.

[73] Assignee: Littelfuse, Inc., Des Plaines, Ill.

[21] Appl. No.: 884,711

[22] Filed: Jun. 30, 1997

Related U.S. Application Data

[63] Continuation-in-part of Ser. No. 642,655, May 3, 1996, Pat. No. 5,699,607.

[60] Provisional application No. 60/010,320 Jan. 22, 1996.

[51] Int. Cl.[6] ..... H01C 17/28; H01C 7/02

[52] U.S. Cl. ..... 29/612; 29/621; 29/874; 29/413; 338/22 R; 338/313; 338/327; 338/332; 427/103

[58] Field of Search ..... 29/612, 621, 874, 29/413; 338/22 R, 313, 327, 332; 427/103

[56] References Cited

U.S. PATENT DOCUMENTS

| | | | |
|---|---|---|---|
| 4,199,745 | 4/1980 | Barry . | |
| 4,786,888 | 11/1988 | Yoneda et al. . | |
| 4,792,781 | 12/1988 | Takahashi et al. . | |
| 4,924,205 | 5/1990 | Caporali et al. | 338/327 |
| 4,959,505 | 9/1990 | Ott . | |
| 5,210,516 | 5/1993 | Shikama et al. | 338/327 |
| 5,257,003 | 10/1993 | Mahoney . | |

FOREIGN PATENT DOCUMENTS

| | | |
|---|---|---|
| 6-112012 | 4/1994 | Japan . |
| 7-161503 | 6/1995 | Japan . |
| WO 94/01876 | 1/1994 | WIPO . |
| WO 95/08176 | 3/1995 | WIPO . |
| WO 95/31816 | 11/1995 | WIPO . |
| WO 95/33276 | 12/1995 | WIPO . |
| WO 95/34084 | 12/1995 | WIPO . |

*Primary Examiner*—P. W. Echols
*Attorney, Agent, or Firm*—Wallenstein & Wagner, Ltd.

[57] ABSTRACT

An electrical device comprising a resistive element having a first electrode in electrical contact with the top surface of the resistive element and a second electrode in electrical contact with the bottom surface of the resistive element. An insulating layer is formed on the first and second electrodes. A portion of the insulating layer is removed from the first and second electrodes to form first and second contact points. A conductive layer is formed on the insulating layer and makes electrical contact with the first and second electrodes at the contact points. The conductive layer has portions removed to form first and second end terminations separated by electrically non-conductive gaps. The wrap-around configuration of the device allows for an electrical connection to be made to both electrodes from the same side of the electrical device.

31 Claims, 9 Drawing Sheets

PROCESS FOR MANUFACTURING AN ELECTRICAL DEVICE COMPRISING A PTC ELEMENT

CROSS-REFERENCE TO RELATED APPLICATION

This application claims the benefit of U.S. Provisional Application Ser. No. 60/010,320 filed Jan. 22, 1996, and is a Continuation-In-Part of Application Ser. No. 08/642,655, filed May 3, 1996 now U.S. Pat. No. 5,699,607.

TECHNICAL FIELD

The present invention relates generally to a surface mountable electrical circuit protection device and a method for making the device.

BACKGROUND OF THE INVENTION

It is well known that the resistivity of many conductive materials change with temperature. Resistivity of a positive temperature coefficient ("PTC") material increases as the temperature of the material increases. Many crystalline polymers, made electrically conductive by dispersing conductive fillers therein, exhibit this PTC effect. These polymers generally include polyolefins such as polyethylene, polypropylene and ethylene/propylene copolymers. Certain doped ceramics such as barium titanate also exhibit PTC behavior.

At temperatures below a certain value, i.e., the critical or switching temperature, the PTC material exhibits a relatively low, constant resistivity. However, as the temperature of the PTC material increases beyond this point, the resistivity sharply increases with only a slight increase in temperature.

Electrical devices employing polymer and ceramic materials exhibiting PTC behavior have been used as overcurrent protection in electrical circuits. Under normal operating conditions in the electrical circuit, the resistance of the load and the PTC device is such that relatively little current flows through the PTC device. Thus, the temperature of the device due to $I^2R$ heating remains below the critical or switching temperature of the PTC device. The device is said to be in an equilibrium state (i.e., the rate at which heat is generated by $I^2R$ heating is equal to the rate at which the device is able to lose heat to its surroundings).

If the load is short circuited or the circuit experiences a power surge, the current flowing through the PTC device increases and the temperature of the PTC device (due to $I^2R$ heating) rises rapidly to its critical temperature. At this point, a great deal of power is dissipated in the PTC device and the PTC device becomes unstable (i.e., the rate at which the device generates heat is greater than the rate at which the device can lose heat to its surroundings). This power dissipation only occurs for a short period of time (i.e., a fraction of a second), however, because the increased power dissipation will raise the temperature of the PTC device to a value where the resistance of the PTC device has become so high that the current in the circuit is limited to a relatively low value. This new current value is enough to maintain the PTC device at a new, high temperature/high resistance equilibrium point, but will not damage the electrical circuit components. Thus, the PTC device acts as a form of a fuse, reducing the current flow through the short circuit load to a safe, relatively low value when the PTC device is heated to its critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

Particularly useful devices of this type generally include a PTC element sandwiched between a pair of laminar electrodes. In order to connect devices of this type to other electrical components, terminals are commonly soldered to the electrode. The soldering process, however, can adversely affect the resistance of a polymeric PTC element. Moreover, since electrical connection generally occurs on opposing sides of the PTC element, devices of this type commonly take up more space on a PC board than is necessary.

SUMMARY OF THE INVENTION

We have now discovered that important advantages result from making electrical connection to both electrodes from the same side of the PTC device. The wrap-around configuration of the PTC devices of the present invention allow one to make an electrical connection to an electrode on the opposite side of the PTC device. Further, since electrical devices of the present invention make electrical connection by wrapping a conductive layer around the PTC element rather than putting a conductive layer through an aperture in the PTC element, the device utilizes the entire PTC element. Moreover, the manufacturing steps necessary to produce electrical devices according to the present invention allow for numerous strips to be prepared simultaneously, with the final strips ultimately divided into a plurality of electrical devices. This process makes it possible to reduce the size and, hence, the resistance of the electrical devices of the present invention.

In one aspect, the present invention provides an electrical device comprising:

- a resistive element having top and bottom surfaces and first and second sides, the top and bottom surfaces each having two end portions separated by a mid-portion;
- a first electrode in electrical contact with the top surface of the resistive element and a second electrode in electrical contact with the bottom surface of the resistive element;
- an insulating layer contacting the first and second electrodes, the insulating layer having a portion removed from the first and second electrodes to form first and second contact points; and,
- a conductive layer formed on the insulating layer and making electrical contact with the first and second electrodes at the contact points, the conductive layer having portions removed to form first and second end terminations separated by electrically non-conductive gaps.

In a second aspect, the present invention provides an electrical device comprising:

- a laminar PTC element comprised of a polymer component and a conductive filler component, the PTC element having a top and bottom surface and a first side and a second side, the top and bottom surfaces each having a pair of end portions separated by a mid-portion;
- a first electrode contacting the top surface of the PTC element and a second electrode contacting the bottom surface of the PTC element;
- an insulating layer formed on the first and second electrodes and the first and second sides of the PTC element, the insulating layer having a portion removed from the first electrode adjacent one end portion of the top surface of the PTC element to define a first contact point and a portion removed from the second electrode adjacent the end portion of the bottom surface of the PTC element opposite the first contact point to define a second contact point;

a first conductive layer formed on the insulating layer and contacting the first and second electrodes at the first and second contact points, the first conductive layer having a first portion removed from the insulating layer adjacent the mid-portion of the top surface of the PTC element to form a first electrically non-conductive gap and a second portion removed from the insulating layer adjacent the mid-portion of the bottom surface of the PTC element to form a second electrically non-conductive gap; and, a second conductive layer formed on the first conductive layer.

A third aspect of the present invention provides a method for manufacturing an electrical device comprising the steps of:

providing a solid laminar PTC sheet having a top and bottom surface, a first electrode formed on the top surface, and a second electrode formed on the bottom surface;

creating a plurality of strips in a regular pattern in the laminar PTC sheet;

coating the strips in the laminar PTC sheet with an insulating layer;

forming a plurality of contact points in a regular pattern on the top and bottom surfaces of each strip in the laminar PTC sheet;

coating the strips in the laminar PTC sheet with a first conductive layer, the first conductive layer being in contact with the electrodes at each contact point;

forming a plurality of electrically non-conductive gaps in the first conductive layer in a regular pattern on the top and bottom surfaces of each strip in the laminar PTC sheet; and, dividing each strip in the laminar PTC sheet into a plurality of electrical devices.

A fourth aspect of the present invention provides a method for manufacturing an electrical device comprising the steps of:

providing a laminar resistive element having a top and bottom surface and first and second sides, the top and bottom surfaces each having end portions separated by a mid-portion;

forming a first electrode on the top surface of the resistive element;

forming a second electrode on the bottom surface of the resistive element;

coating the first and second electrodes and the first and second sides of the resistive element with an insulating layer;

removing a first portion of the insulating layer to form a first contact point;

removing a second portion of the insulating layer to form a second contact point;

applying a first conductive layer to the insulating layer, the first contact point and the second contact point;

removing portions of the first conductive layer to form first and second end terminations separated by electrically non-conductive gaps; and, applying a second conductive layer to the first conductive layer.

In a fifth aspect, the present invention provides a method for manufacturing an electrical device comprising the steps of:

providing a laminar conductive sheet having a top and bottom surface, a first electrode formed on the top surface, and a second electrode formed on the bottom surface;

creating a plurality of strips in a regular pattern in the laminar conductive sheet;

coating the strips in the laminar conductive sheet with an insulating layer;

forming a plurality of contact points in a regular pattern on the top and bottom surfaces of each strip in the laminar conductive sheet;

coating the strips in the laminar conductive sheet with a first conductive layer, the first conductive layer being in contact with the electrodes at each contact point;

forming a plurality of electrically non-conductive gaps in the first conductive layer in a regular pattern on the top and bottom surfaces of each strip in the laminar conductive sheet; and, dividing each strip in the laminar conductive sheet into a plurality of electrical devices.

In a final aspect, the present invention provides a method for manufacturing an electrical device comprising the steps of:

providing a laminar PTC sheet having a top and bottom surface, a first electrode formed on the top surface, and a second electrode formed on the bottom surface;

creating a plurality of strips in a regular pattern in the laminar PTC sheet;

forming a plurality of electrically non-conductive gaps in the first and second electrodes;

coating the strips in the laminar PTC sheet with an insulating layer;

removing portions of the insulating layer to expose opposed end portions of the PTC sheet;

applying a first conductive layer to the end portions to form end terminations; and, dividing each strip in the laminar PTC sheet into a plurality of electrical devices.

BRIEF DESCRIPTION OF THE DRAWINGS

A better understanding of the present invention will be had upon reference to the following detailed description and accompanying drawings. The size and thickness of the various elements illustrated in the drawings has been greatly exaggerated to more clearly show the electrical devices of the present invention.

DETAILED DESCRIPTION OF THE INVENTION

Figure 4:
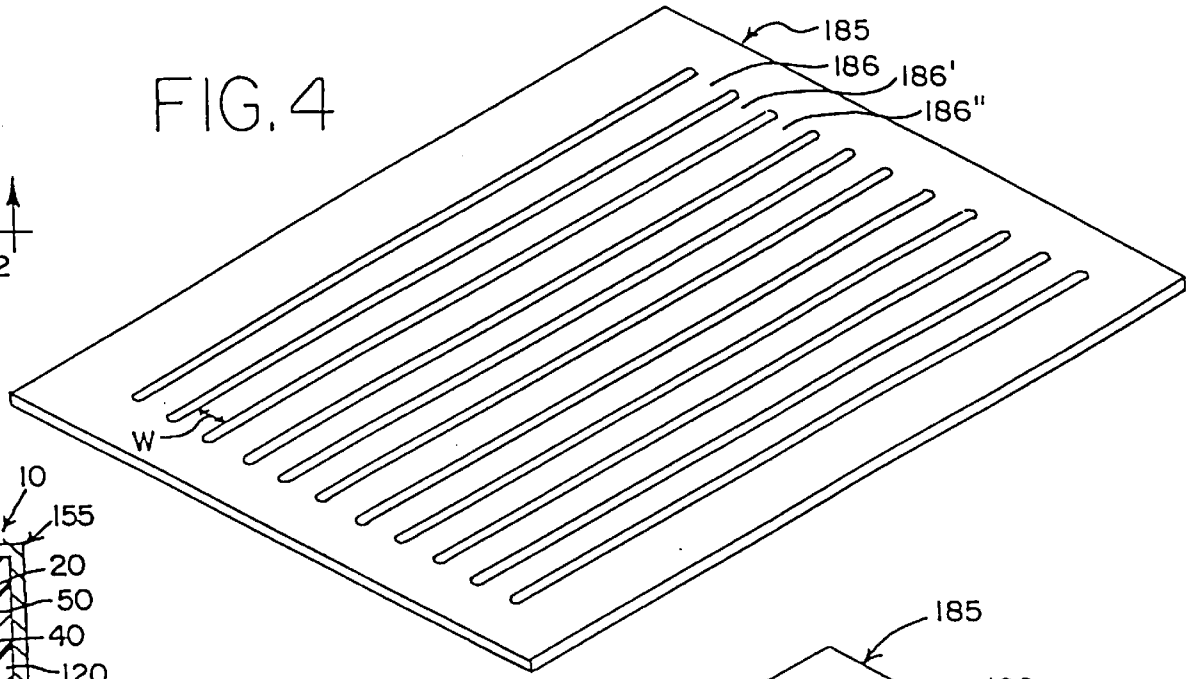
FIG. 4 is a perspective view of a laminar PTC sheet having a plurality of strips created in a regular pattern.

While this invention is susceptible of embodiment in many different forms, there is shown in the drawings and will herein be described in detail preferred embodiments of the invention with the understanding that the present disclosure is to be considered as an exemplification of the principles of the invention. For example, the present invention will be described below generally with reference to a polymer PTC element having electrodes formed on the top and bottom surfaces. It is to be understood, however, that the present invention contemplates electrical devices with a ceramic PTC element, or a resistive element that does not exhibit PTC characteristics.

Generally, the resistive element of the present invention will be composed of a PTC composition comprised of a polymer component and a conductive filler component. The polymer component may be a single polymer or a mixture of two or more different polymers. The polymer component may comprise a polyolefin having a crystallinity of at least 40%. Suitable polymers include polyethylene, polypropylene, polybutadiene, polyethylene acrylates, ethylene acrylic acid copolymers, and ethylene propylene copolymers. In a preferred embodiment, the polymer component comprises polyethylene and maleic anhydride (such a polymer is manufactured by Du Pont and sold under the tradename Fusabond™). The conductive filler component is dispersed throughout the polymer component in an amount sufficient to ensure that the composition exhibits PTC behavior. Alternatively, the conductive filler can be grafted to the polymer. Generally, the conductive filler component will be present in the PTC composition by approximately 25–75% by weight. Suitable conductive fillers to be used in the present invention include powders, flakes or spheres of the following metals; nickel, silver, gold, copper, silver-plated copper, or metal alloys. The conductive filler may also comprise carbon black, carbon flakes or spheres, or graphite. In a preferred embodiment, the conductive filler component used in the present invention is carbon black (manufactured by Columbian Chemicals and sold under the tradename Raven™). Particularly useful PTC compositions have a resistivity at approximately 25° C. of less than 10 ohm cm, particularly less than 5 ohm cm, and especially less than 3 ohm cm. Suitable PTC compositions for use in the present invention are disclosed in U.S. patent application Ser. No. 08/614,038, and U.S. Pat. Nos. 4,237,441, 4,304,987, 4,849,133, 4,880,577, 4,910,389 and 5,190,697. The PTC element has a first electrode in electrical contact with the top surface and a second electrode in electrical contact with the bottom surface. The electrodes may be in direct physical contact with the top and bottom surfaces of the PTC element, however, electrical devices of the present invention may also include a conductive adhesive composition which lies between the electrodes and the PTC element.

In a preferred embodiment, the PTC element is sandwiched between two metal foil electrodes to form a laminate. Alternatively, the electrodes can be formed on the top and bottom surfaces of the PTC element using conventional electroless or electrolytic plating processes. The first and second electrodes preferably comprise a metal selected from the group consisting of nickel, copper, silver, tin, gold and alloys thereof.

Figure 1:
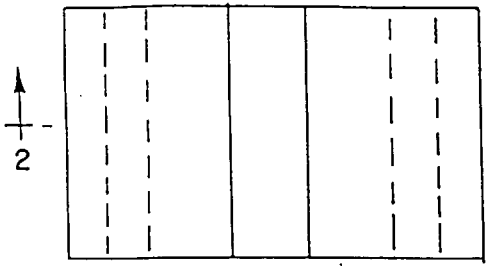
FIG. 1 is a top view of an electrical device according to the present invention.
Figure 2:
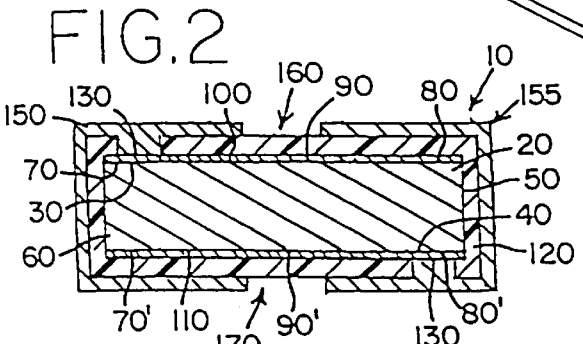
FIG. 2 is a cross-sectional view along line a—a of a first embodiment of the electrical device illustrated in FIG. 1.
Figure 3:
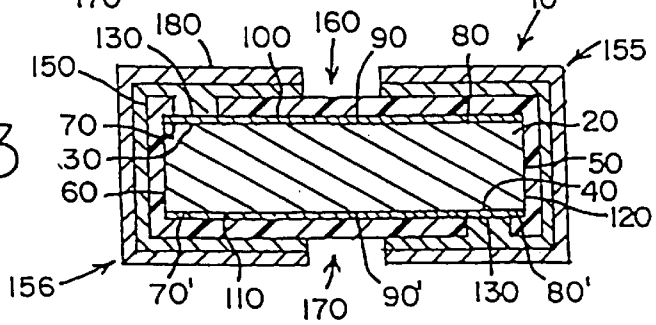
FIG. 3 is a cross-sectional view along line a—a of a second embodiment of the electrical device illustrated in FIG. 1.

With reference now to FIGS. 1–3, the electrical device 10 of the present invention comprises a resistive element 20 having a top surface 30, a bottom surface 40, a first side 50 and a second side 60. Both the top and bottom surfaces 30, 40 have two end portions 70, 80 and 70', 80' separated by mid-portions 90, 90'. A first electrode 100 is formed on the top surface 30 of resistive element 20 and a second electrode 110 is formed on the bottom surface 40 of resistive element 20. As previously mentioned, preferably resistive element 20 is composed of a polymer PTC composition.

An insulating layer 120 is formed on electrodes 100, 110 and the first side 50 and the second side 60 of the resistive element 20. The insulating layer 120 can be composed of a photo resist material, a dielectric material, a ceramic material, a solder mask, or any electrically non-conductive material. The insulating layer 120 has a portion removed from the first electrode 100 to define a first contact point 130 and a portion removed from the second electrode 110 to define a second contact point 140. In the preferred embodiments illustrated in FIGS. 2–3, the first contact point 130 is adjacent the end portion 70 of the top surface 30 of the resistive element 20, while the second contact point 140 is adjacent the end portion 80' of the bottom surface 40 of the resistive element 20 (i.e., the first and second contact points 130, 140 are located on opposite sides and opposite ends of the electrical device 10). While this configuration is preferred, the present invention covers electrical devices having contact points located anywhere along the first and second electrodes provided that electrical connection can be made to both electrodes from the same side of the electrical device.

A first conductive layer 150 is formed on the insulating layer 120 and makes electrical contact with the first and second electrodes 100, 110 at first and second contact points 130, 140. Conductive layer 150 may be comprised of any conductive material, but preferably comprises a metal selected from the group consisting of copper, tin, silver, nickel, gold and alloys thereof. It is important that the first conductive layer wrap-around the sides of the electrical device. This wrap-around configuration allows for electrical connection to be made to both electrodes from the same side of the electrical device.

The first conductive layer 150 has portions removed from insulating layer 120 to form end terminations 155, 156. Each end termination includes a contact point. The end terminations 155, 156 are separated by electrically non-conductive gaps 160, 170. FIGS. 2–3 illustrate an electrical device 10 wherein the electrically non-conductive gaps 160, 170 are formed adjacent the mid-portions 90, 90' of the top and bottom surfaces 30, 40 of resistive element 20. It should be understood, however, that the electrically non-conductive gaps 160, 170 can be formed anywhere in the first conductive layer 150 as long as the electrically non-conductive gaps separate end terminations 155, 156, with each end termination including a contact point. This configuration prevents current from flowing circularly around the electrical device. Instead, current may flow around either end portion of the electrical device via an end termination, to the first contact point, and through the resistive element to the second contact point formed on the opposite side of the electrical device.

The electrically non-conductive gaps 160, 170 can be formed by a conventional etching process. In FIGS. 2–3, the non-conductive gaps 160, 170 are left vacant, thus exposing insulating layer 120. Alternatively, the non-conductive gaps 160, 170 can be filled with any electrically non-conductive material.

Referring specifically to FIG. 3, in a preferred embodiment of the present invention, a second conductive layer 180 is formed on the first conductive layer 150. The second conductive layer should not bridge non-conductive gaps 160, 170 or any electrically non-conductive material which might fill the non-conductive gaps 160, 170. The second conductive layer 180 is preferably a solder composition which allows the device 10 to be easily connected to the conductive terminals of a PC board. By completely coating the first conductive layer 150 with the second conductive layer 180, the electrical device 10 of the preferred embodiment is symmetrical. Accordingly, the device 10 does not need to be oriented in a special manner before it is mounted to a PC board or connected to additional electrical components. It should be understood, however, that the present invention covers an electrical device 10 where the second conductive layer 180 contacts only a portion of the first conductive layer 150, or is in contact with the first conductive layer 150 on one side of the device only, i.e., a non-symmetrical device.

Electrical devices of the present invention have a resistance at approximately 25° C. of less than 1 ohm, preferably less than 0.5 ohm, and especially less than 0.2 ohm.

The electrical devices of the present invention can be manufactured in various ways. However, as illustrated in FIG. 4, the preferred method provides for carrying out the processing steps on a relatively large laminar sheet 185 which comprises a plurality of strips 186, 186', 186", etc. The final processing step includes dividing the strips into a plurality of electrical devices. Accordingly, extremely small electrical devices with low resistances can be produced in an economical fashion.

In a preferred method, electrodes are formed on the top and bottom surfaces of a solid laminar PTC sheet of convenient size. As previously mentioned, preferably the PTC sheet is laminated between two metal foil electrodes. Alternatively, electrodes may be plated directly on the top and bottom surfaces of the PTC sheet using conventional electrolytic or electroless plating processes. Referring to FIG. 4, the terminated laminar PTC sheet is then routed or punched to create a plurality of strips 186, 186', 186", etc. The strips are created in a regular pattern and preferably have a width, W, approximately the desired length of the final electrical device. For example, a laminar PTC sheet approximately 6 inches wide by 8 inches long by 0.0150 inches thick may be routed or punched to create a plurality of strips 186, 186', 186", etc. approximately 7 inches in length with a width of approximately 0.160–0.180 inches or less. The top and bottom surfaces of each strip are composed of the first and second electrodes 100, 110. The side surfaces of each strip are composed of PTC element 20 due to the routing or punching procedure.

Figure 4A:
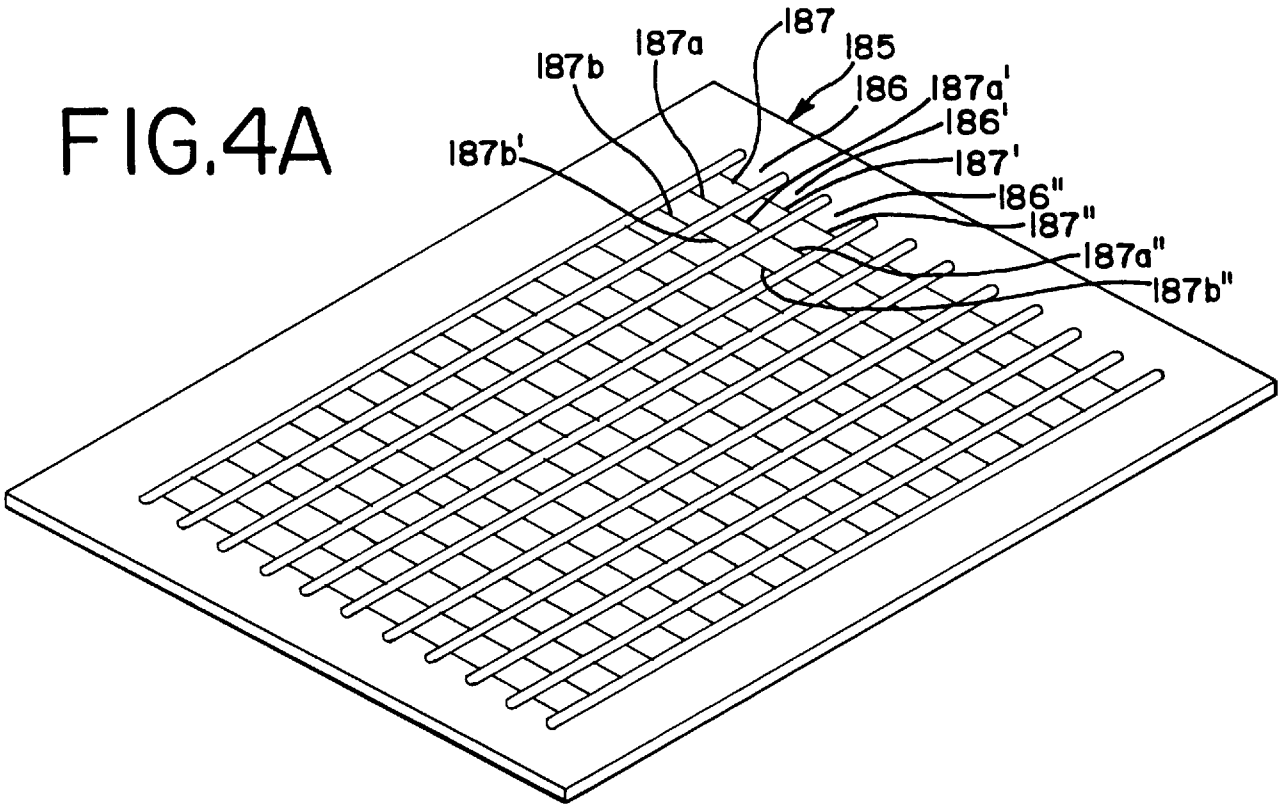
FIG. 4A is a perspective view of the laminar PTC sheet illustrated in FIG. 4 having a plurality of break points created on each strip.

After the laminated PTC sheet is routed, a plurality of break points 187, 187', 187" . . . 187*a*, 187*a'*, 187*a"* . . . 187*b*, 187*b'*, 187*b"* . . . etc. are created horizontally across each strip (FIG. 4A). The break points allow the final strips to be divided into a plurality of electrical devices by exerting minimal pressure at each break point. Thus, the final strips can be efficiently divided into a plurality of electrical devices by snapping or simply running the strip over an edge. Laboratory tests have indicated that without break points, the conductive layers (described in detail below) tend to smear upon dividing the strips into electrical devices with conventional dicing and shearing techniques. Smeared conductive layers lead to faulty electrical devices and the increased possibility of short circuits.

Generally, the break points are created by removing portions of the electrodes on both the top and bottom surfaces of each strip. This can be accomplished by laminating the routed, terminated PTC sheet illustrated in FIG. 4 with a dry film photo resist material. A masking material is laid over the portions of the photo resist material which are to be developed or cured, leaving a plurality of unmasked regions approximately 5 mils thick stretching horizontally across each strip. Preferably, the unmasked regions are formed on the routed, terminated laminar PTC sheet in the same direction as the direction in which the PTC composition was extruded. Since the polymer chains in the PTC composition are elongated in the direction of extrusion, the brittleness of the PTC sheet is anisotropic. That is, the PTC sheet is stronger in one direction (i.e., perpendicular to the direction of extrusion) than it is in the direction parallel to extrusion. Thus, by creating the break points parallel to the direction of extrusion, the final strips may be easily divided into a plurality of electrical devices.

The unmasked regions should be created to leave a plurality of masked portions having a dimension approximately equal to the desired width of the final electrical device, e.g., 0.100–0.150 inches or less. The strips are then exposed to ultraviolet light whereby the unmasked regions of the photo resist material degrade. The degraded photo resist material is rinsed away to expose portions of the electrode surfaces. The exposed portions of the electrodes are then removed by a conventional etching process (e.g., subjecting the exposed electrode surfaces to a ferric chloride solution), thus, creating a plurality break points. Finally, the developed or cured dry film photo resist material is chemically removed by dipping the PTC sheet into a solvent such as potassium hydroxide.

Figure 5:
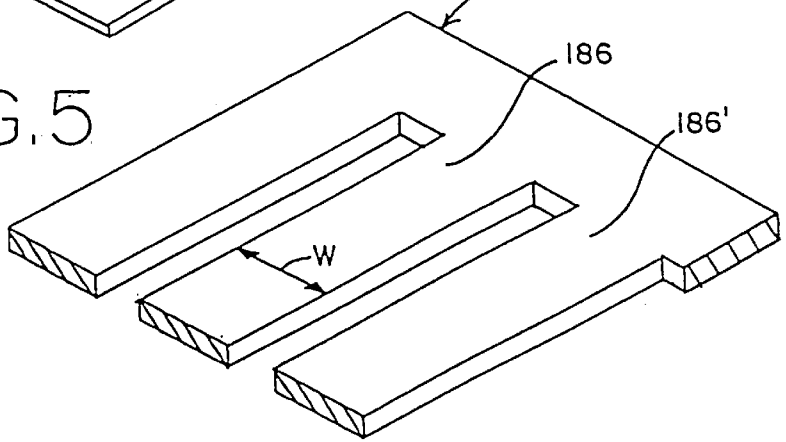
FIG. 5 is a partial enlarged perspective view of the laminar PTC sheet having a plurality of strips as illustrated in FIG. 4.

FIG. 5 illustrates a partial enlarged cross-sectional view of several strips of the laminar PTC sheet. While the various process steps are to be carried out after the break points have been formed on the routed PTC sheet, for purposes of clarity, the various process steps will be discussed with reference to a cross-section of a single strip (illustrated in FIGS. 6A–6H and 7A–7D).

Figure 6A:
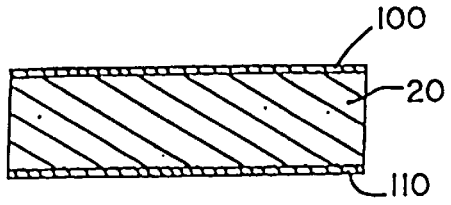
FIGS. 6A–6H illustrate the various steps of a preferred method of manufacturing electrical devices of the present invention, as applied to a cross-section of a single strip of the PTC sheet in FIG. 4A.
Figure 6B:
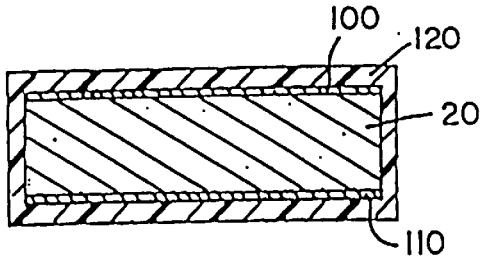

After the break points have been created on each strip of the routed, terminated laminar PTC sheet (FIG. 6A), the strips of the laminar PTC sheet are coated with an insulating layer 120 (FIG. 6B). The insulating layer 120 may be applied using any one of the following conventional techniques: brushing, laminating, dipping, screen printing or spraying. The insulating layer 120 may comprise any electrically non-conductive material, however, preferred materials include a photo resist material, a ceramic material, a dielectric material, or a solder mask.

Figure 6C:
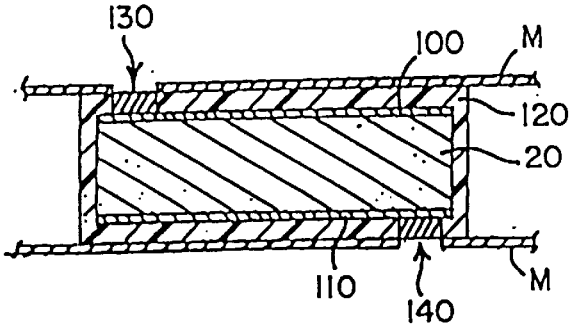
Figure 6D:
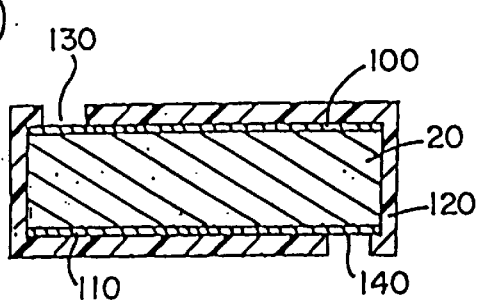

A plurality of contact points 130, 140, are formed in a regular pattern on the top and bottom surfaces of each strip (FIGS. 6C–6D). It should be understood that the present invention covers methods where the insulating layer 120 is applied to the strips leaving portions of the electrodes 100, 110 initially exposed to create the contact points 130, 140. Additionally, the present invention covers methods where the insulating layer 120 is initially applied to the entire surface of each strip. Contact points 130, 140 are then formed by removing portions of the insulating layer 120. For example, referring to FIGS. 6B–6D, a positive working photo resist material is used as the insulating layer 120. A mask, reference letter M in FIG. 6C, is applied to the portions of the photo resist material which are to be developed or cured on the surfaces of each strip, leaving portions of the photo resist material which will form the contact points 130, 140 unmasked (shown as cross-hatched portions of the insulating layer in FIG. 6C). The strips are then exposed to ultraviolet light whereby the unmasked portions of the photo resist material degrade. The degraded photo resist material is rinsed away to expose the electrode surfaces (FIG. 6D), thus, forming a plurality of contact points on the top and bottom surfaces of each strip. This process can be reversed using a negative photo resist material (i.e., the unmasked portions will develop or cure upon exposure to ultraviolet light).

Figure 6E:
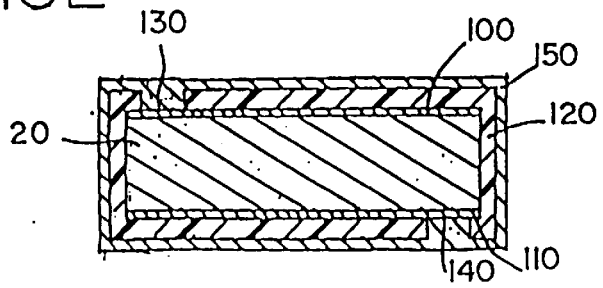

After the plurality of contact points 130, 140 has been formed, a first conductive layer 150 is applied to the strips (FIG. 6E). The conductive layer 150 may be applied by a conventional plating technique (e.g., electroless plating). Alternatively, the conductive layer may be applied by dipping, spraying or brushing a conductive material to the strips in a liquid form. In a preferred embodiment the first conductive layer 150 comprises a metal selected from the group consisting of nickel, copper, tin, silver, gold or alloys thereof. The first conductive layer 150 must make electrical contact with the electrodes 100, 110 at each contact point formed on the strips.

As illustrated in FIGS. 2–3 and 6E, the first conductive layer 150 wraps around the end portions of the electrical device 10. This wrap-around configuration makes it possible to make electrical contact to both electrodes from the same side of the electrical device.

Figure 6F:
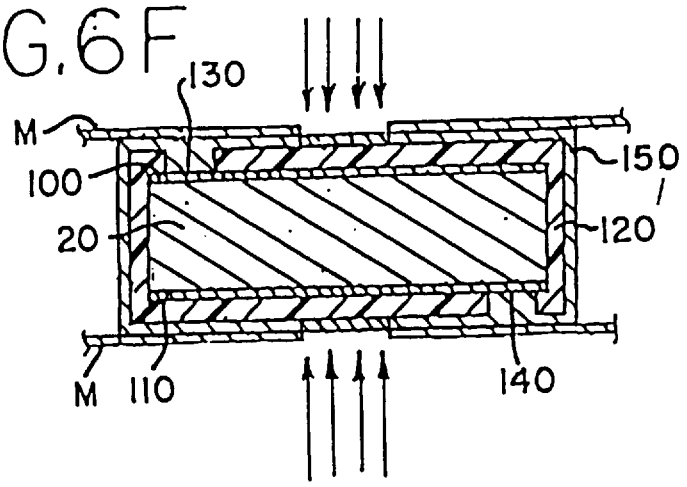
Figure 6G:
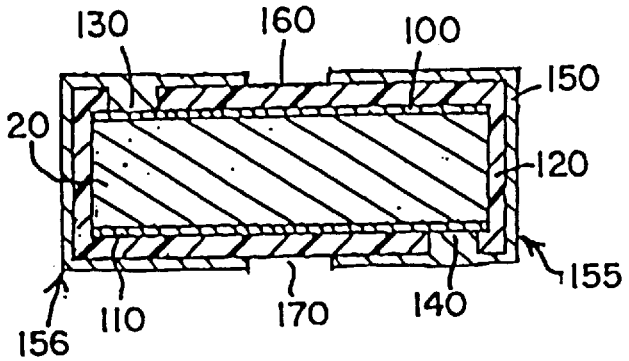

In the next step, a plurality of electrically non-conductive gaps 160, 170 are formed in the first conductive layer 150 in a regular pattern on the top and bottom surfaces of each strip (FIGS. 6F–6G). The electrically non-conductive gaps 160, 170 may be formed by applying the first conductive layer 150 initially in a manner which leaves portions of the insulating layer 120 exposed. However, the present invention also covers methods where each strip is completely covered with the first conductive layer 150 and the electrically non-conductive gaps 160, 170 are created by removing portions of the first conductive layer 150 in a regular pattern on the top and bottom surfaces of each strip. Either process results in forming on each strip a plurality of first and second end terminations 155, 156 separated by the electrically non-conductive gaps 160, 170.

For example, with reference to FIGS. 6E–6G, a protective mask, reference letter M in FIG. 6F, is applied to the conductive layer 150, leaving predetermined portions exposed (the exposed portions are represented by the cross-hatched sections of the conductive layer 150 in FIG. 6F). The exposed portions are then removed by a conventional etching process, e.g., subjecting the exposed portions to a ferric chloride solution.

Figure 7A:
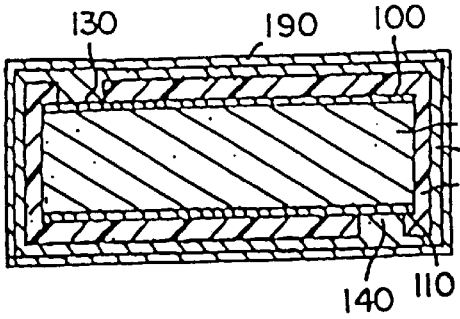
FIGS. 7A–7D illustrate the steps of a second preferred method of manufacturing electrical devices of the present invention, starting with the device illustrated in FIG. 6E.
Figure 7B:
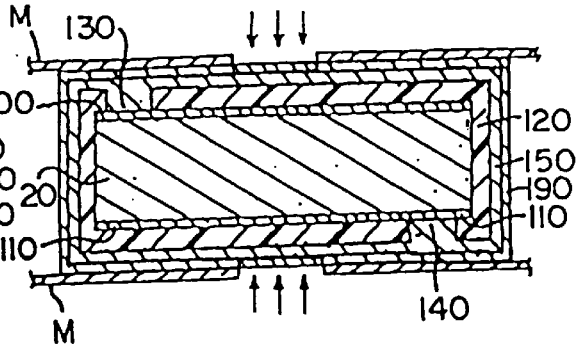
Figure 7C:
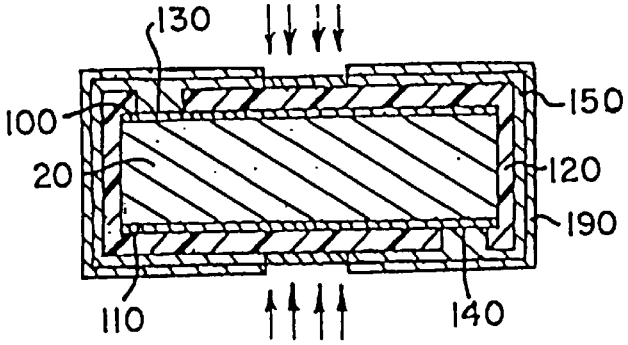
Figure 7D:
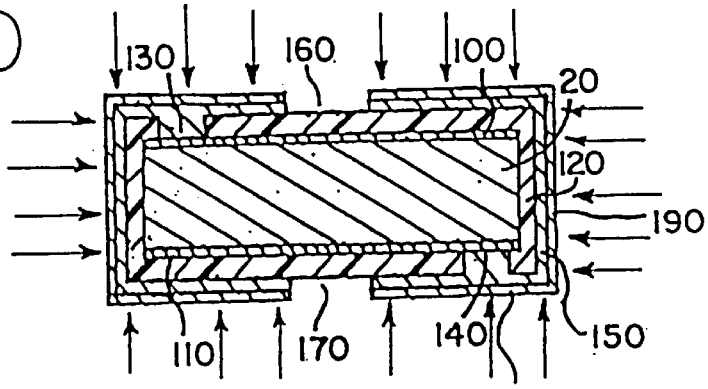

Alternatively, the electrically non-conductive gaps 160, 170 and end terminations 155, 156 can be formed by the following method. First conductive layer 150 is applied to each strip, coating insulating layer 120 and contact points 130, 140 (FIG. 6E). Referring now to FIGS. 7A–7D, a photo resist material 190 is applied to the conductive layer 150. If a photo resist material is used to form insulating layer 120, then the second photo resist material 190 used in this step must have an opposite reaction to ultraviolet light (i.e., if a negative-working photo resist material was used to form the insulating layer, than a positive-working photo resist material must be used to form the electrically non-conductive gaps in the conductive layer and vice-versa). A masking material, reference letter M in FIG. 7B, is applied to the outer photo resist layer 190, leaving a plurality of portions of the top and bottom surfaces of the layer 190 exposed in a regular pattern. The strips are then subjected to ultraviolet light, causing the unmasked portions of the outer photo resist layer 190 to degrade. The degraded portions of the photoresist material 190 are rinsed away, leaving a plurality of portions of the first conductive layer 150 exposed in a regular pattern on the top and bottom surfaces of each strip (FIG. 7C). The exposed portions of the conductive layer 150 (shown as cross-hatched sections of the conductive layer in FIG. 7C) are then removed by dipping the strips in a standard etching solution. As a result, portions of insulating layer 120 are exposed. The outer photo resist material 190 is then removed by further exposing the strips to ultraviolet light (FIG. 7D). Since portions of the insulating layer 120 are exposed during this step, it is important to use a photo resist material 190 which has an opposite reaction to ultraviolet light than the photo resist material that may have been used to form insulating layer 120.

As a result of either process, i.e., (1) applying the conductive layer to the entire surface of the strips and then removing portions of the conductive layer or, (2) initially applying the conductive layer in a manner which leaves portions of the insulating layer exposed, first and second end terminations 155, 156 are formed (FIG. 6G).

Figure 6H:
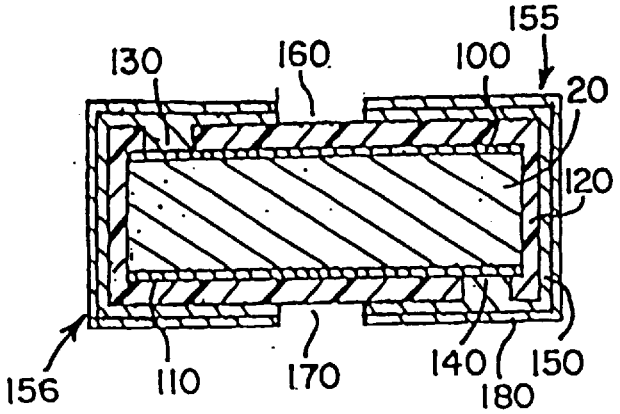

In the preferred embodiment illustrated in FIGS. 3 and 6H, a second conductive layer 180 is applied to the first conductive layer 150. The second conductive layer 180 is preferably comprised of a solder composition and can be applied by any conventional process, including electrolytic plating or solder dipping. The layer of solder permits the electrical devices 10 of the present invention to be easily connected to the conductive terminals of a PC board.

In the final step, the strips are divided at each break point into a plurality of electrical devices such that each device has a contact point and an electrically non-conductive gap on both sides (i.e., top and bottom) of the device. As previously mentioned, the strips may be divided into a plurality of electrical devices by simply applying a minimal amount of pressure at each break point.

Figure 8:
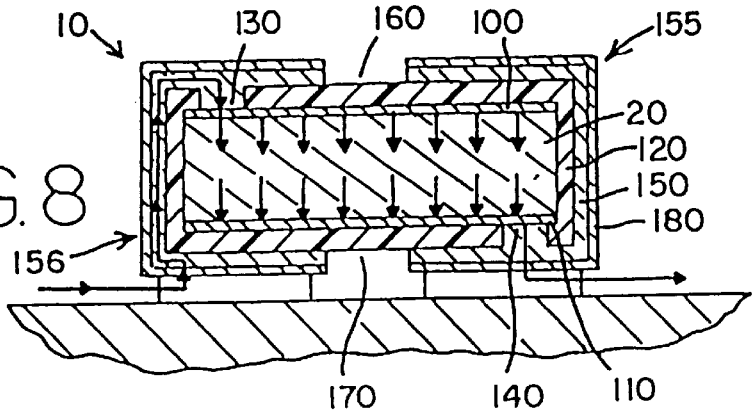
FIG. 8 is a cross-sectional view of a preferred embodiment of the device in FIG. 1 soldered to a PC board.

With reference to FIG. 8, the arrows indicate the flow of current through the device. The end terminations allow current to flow from a conductive terminal of a PC board, around the outer edge of the device (via the first end termination), to the first electrode at the first contact point. The current then flows through the PTC element to the second electrode. Current exits the device through the contact point of the second end termination and continues to flow through the remainder of the circuit.

In another preferred method, electrodes are formed on the top and bottom surfaces of a solid laminar PTC sheet of convenient size. A plurality of break points are also formed as previously described. The process steps for formation of the final electrical device of this embodiment are now described with reference to a cross-section of a single strip (illustrated in FIGS. 9A–9G and 10).

Figure 9A:
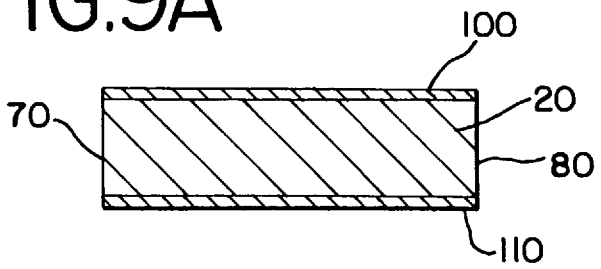
FIGS. 9A–9G illustrate the steps of a third preferred method of manufacturing electrical devices of the present invention as applied to a cross-section of a single strip of the PTC sheet in FIG. 4A.
Figure 9B:
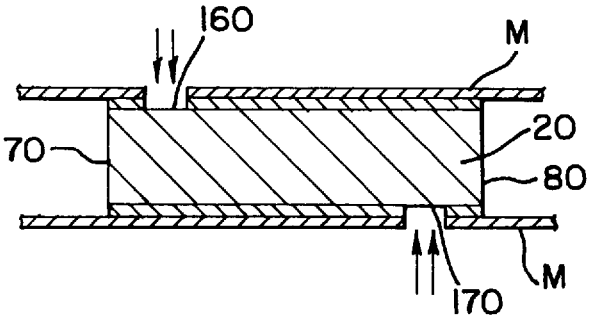

A masking material, reference letter M in FIG. 9B, is applied to the electrodes 100, 110, leaving a plurality of unmasked regions horizontally across each electrode. As previously described, the unmasked portions of the first and second electrodes 100, 110 are then removed by a conventional etching process (e.g., subjecting the exposed electrode surfaces to a ferric chloride solution), thus, creating a plurality of electrically non-conductive gaps 160, 170 in the first and second electrodes. Forming electrically non-conductive gaps 160, 170 directly in the first and second electrodes 100, 110 results in fewer process steps required for the formation of the electrical device 10 of this embodiment.

Figure 9C:
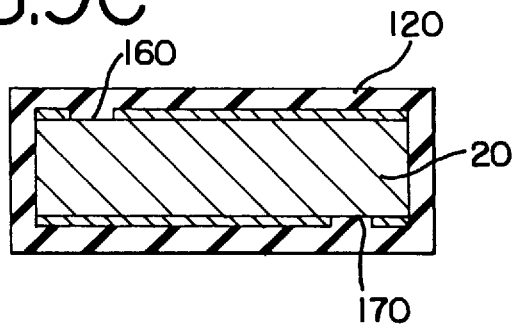

After creation of the non-conductive gaps 160, 170 on each electrode, the electrodes and the laminated PTC sheet are coated with an insulating layer 120. As shown in FIG. 9C, the insulating layer 120 fills the non-conductive gaps 160, 170. As previously described, the insulating layer 120 may be applied using any one of the following conventional techniques: brushing, laminating, dipping, screen printing or spraying. The insulating layer 120 may comprise any electrically non-conductive material; however, preferred materials include a photo resist material, a ceramic material, a dielectric material, or a solder mask.

Figure 9D:
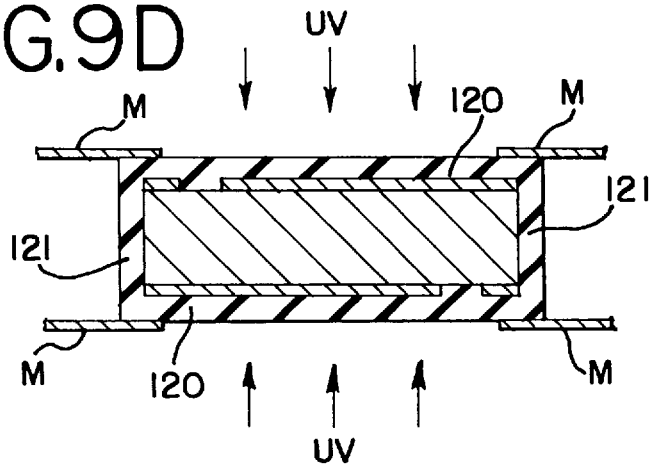
Figure 9E:
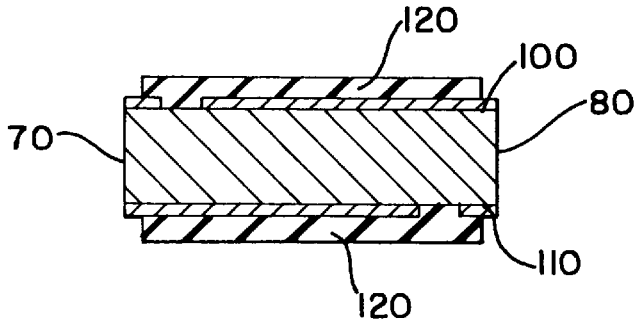

After application of the insulating layer 120, a masking material, reference letter M in FIG. 9D, is applied to the side portions of strip. The masking material covers the insulating layer 120 and stops short of the electrically non-conductive gaps 160, 170, leaving the insulating layer 120 on the two top and bottom middle portions of the PTC element exposed. The result is a masked, U-shaped portion 121 of the insulating layer 120 around each end portion of the PTC element (FIG. 9D). The strip is then exposed to ultraviolet light, causing the unmasked portions of the insulating layer 120 to harden or cure. The masked portions are unaffected by the ultraviolet light and rinsed away with a conventional solvent, leaving the two end portions 70, 80 of the PTC sheet and portions of the first and second electrodes 100, 110 exposed (FIG. 9E).

Figure 9F:
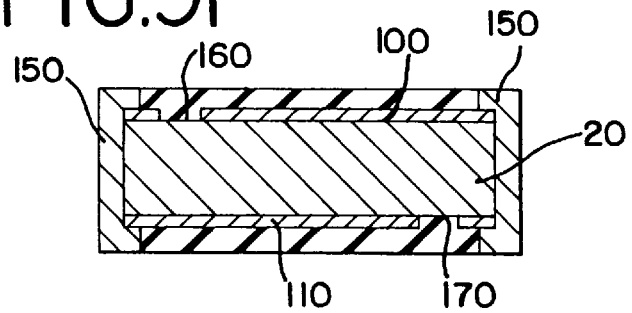

FIG. 9F illustrates the next step in the process wherein a first conductive layer 150 is applied to the exposed ends 70, 80 of the PTC sheet and adjacent to the electrically non-conductive gaps 160, 170 in the electrodes. As previously described, the first conductive layer 150 may be applied by a conventional plating technique (e.g., electrolytic plating). Alternatively, the conductive layer 150 may be applied by electroless plating, direct metallization, or dipping, spraying or brushing a liquid conductive material to the strips. The first conductive layer 150 may comprise a metal selected from the group consisting of nickel, copper, tin, silver, gold or alloys thereof. However, in a preferred embodiment, the first conductive layer 150 is copper. The first conductive layer 150 wraps around the exposed end portions 70, 80 of the electrical device, ending adjacent to the non-conductive gaps 160, 170 formed in the electrodes. The first conductive layer 150 forms first and second end terminations 155, 156 on each end of the device. The end terminations 155, 156 are separated by the electrically non-conductive gaps 160, 170 in the first and second electrodes.

Figure 9G:
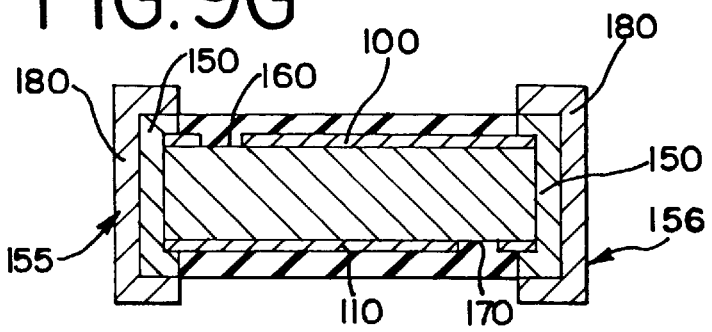

With reference to FIG. 9G, a second conductive layer 180 is applied to the first conductive layer 150. The second conductive layer 180 is preferably comprised of a solder composition (i.e., a tin/lead mixture) and can be applied by any conventional process, including electrolytic plating or solder dipping. The layer of solder permits the electrical devices 10 of the present invention to be easily connected to the conductive terminals of a PC board. To further improve solderability, a nickel layer may be applied to the copper layer prior to the application of the solder layer.

The final step in the process again involves dividing the strips at each break point into a plurality of electrical devices. The strips may also be divided into individual electrical devices by using a conventional shearing or punching process.

Figure 10:
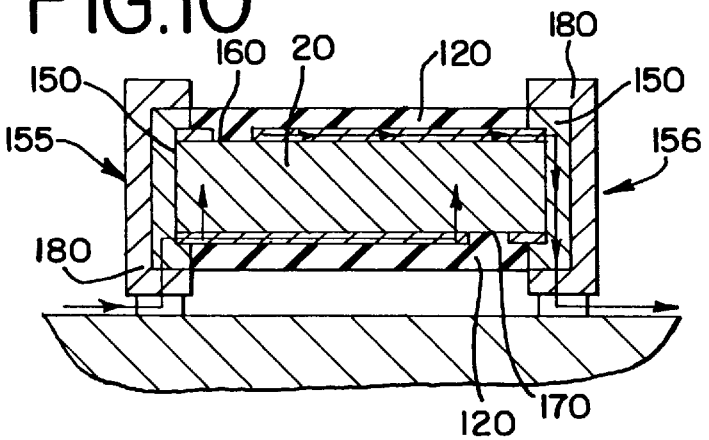
FIG. 10 is a cross-sectional view of a preferred embodiment of the device in FIGS. 9A–9G soldered to a PC board.

With reference to FIG. 10, the arrows indicate the flow of electrical current through the device, which is in a manner different from the previously-described embodiments of the present invention. The first end termination 155 allows current to flow from a conductive terminal of a PC board, up through the second 110 (or bottom) electrode. The current flows through the PTC element 20 to the first 100 (or top) electrode. Current then flows around the second end termination 156, exits the device, and continues to flow through the remainder of the circuit.

In another preferred method, electrodes are formed on the top and bottom surfaces of a solid laminar PTC sheet of convenient size. A plurality of break points are also formed as previously described. The process steps for formation of the final electrical device of this embodiment are now described with reference to a cross-section of a single strip (illustrated in FIGS. 11A–11G and 12).

Figure 11A:
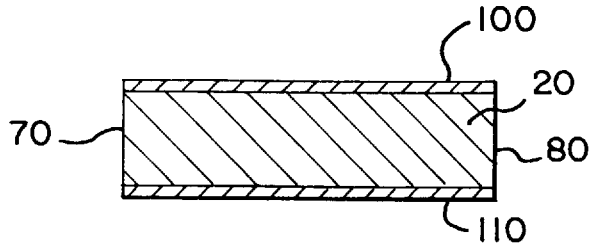
FIGS. 11A–11G illustrate the steps of a fourth preferred method of manufacturing electrical devices of the present invention as applied to a cross-section of a single strip of the PTC sheet in FIG. 4A.
Figure 11B:
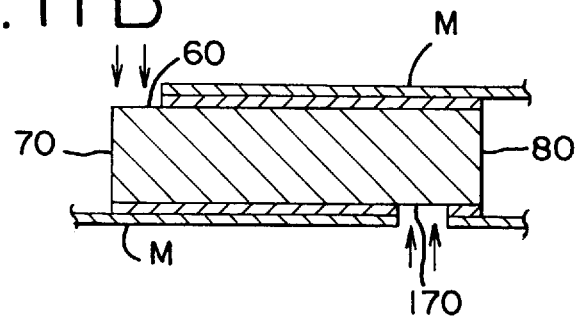

A masking material, reference letter M in FIG. 11B, is applied to the electrodes 100, 110, leaving a plurality of unmasked regions horizontally across each electrode. Optionally, a stencil material having a plurality of blackened areas is laid over the masking material with the blackened areas aligned with the unmasked regions of the electrodes (not shown). The strip is then exposed to ultraviolet light, which penetrates through the stencil material, except the blackened areas, and to the masked portions. The stencil is removed and as previously described, the unmasked portions of the first and second electrodes 100, 110 are then removed by a conventional etching process (e.g., subjecting the exposed electrode surfaces to a ferric chloride solution), thus, creating a plurality of electrically non-conductive gaps 160, 170 in the first and second electrodes. In this preferred embodiment, the non-conductive gap 160 in the first electrode is formed at the end of the electrode adjacent the first end portion 70 of the device (FIG. 11B). Forming electrically non-conductive gaps 160, 170 directly in the first and second electrodes 100, 110 results in fewer process steps required for the formation of the electrical device 10 of this embodiment.

Figure 11C:
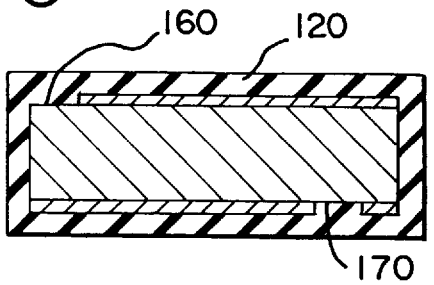

After creation of the non-conductive gaps 160, 170 on each electrode, the electrodes and the laminated PTC sheet are coated with an insulating layer 120. As shown in FIG. 11C, the insulating layer 120 fills the non-conductive gaps 160, 170. The insulating layer 120 is applied by any of the techniques previously described. The insulating layer 120 may comprise any electrically non-conductive material, but preferred materials include a photo resist material, a ceramic material, a dielectric material, or a solder mask.

Figure 11D:
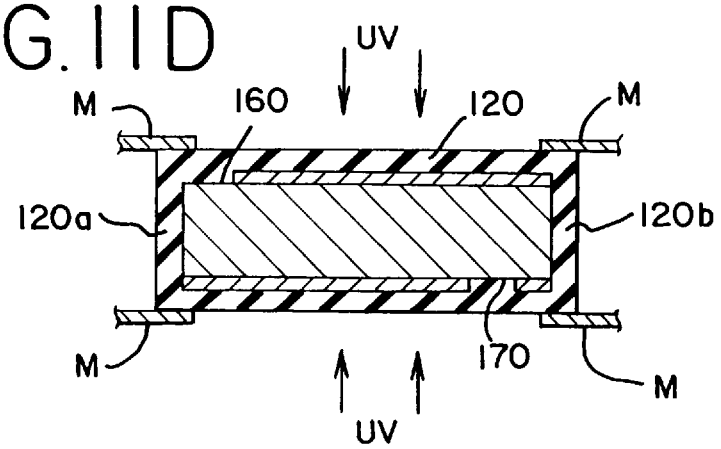
Figure 11E:
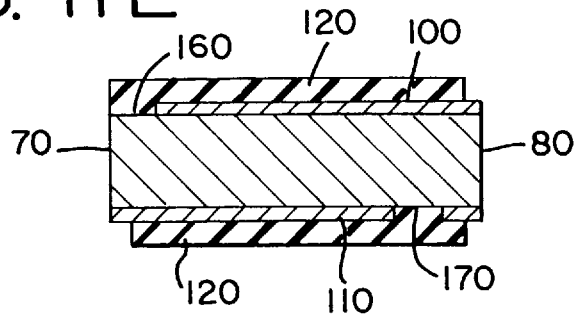

With reference to FIG. 11D, after application of the insulating layer 120, a masking material, reference letter M, is applied to the top and bottom surfaces of each strip. In this preferred embodiment, the masking material covers the insulating layer 120 on the first end portion 70 leaving an L-shaped area 120*a* of insulating material, adjacent the first electrically non-conductive gap 160. On the opposed second end portion 80, the masking material covers the insulating layer falling just short of the second electrically non-conductive gap 170, resulting in a U-shaped area 120*b* of insulating layer (FIG. 11D). The strip is then exposed to ultraviolet light curing the unmasked portions of the insulating layer 120. The masked portions of the insulating layer 120 are rinsed away, leaving the two end portions 70, 80 of the PTC sheet and portions of the first and second electrodes 100, 110 exposed (FIG. 11E).

Figure 11F:
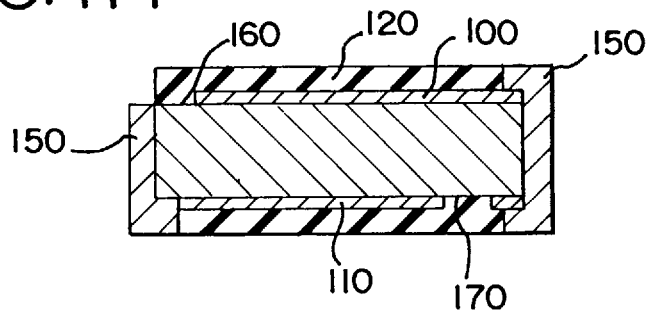

FIG. 11F illustrates the next step in the process wherein a first conductive layer 150 is applied by a conventional plating technique (e.g., electrolytic plating), or alternatively, by dipping, spraying or brushing a liquid conductive material to the strips. The first conductive layer 150 is also in contact with the exposed ends 70, 80 of the PTC sheet and adjacent to the electrically non-conductive gaps 160, 170 in the electrodes. While the first conductive layer 150 may comprise a metal selected from the group consisting of nickel, copper, tin, silver, gold or alloys thereof, in this preferred embodiment, the first conductive layer 150 is copper. The first conductive layer 150 forms an L-shaped end termination 155 around the first end portion 70 of the electrical device, and a U-shaped end termination 156 around the second end portion 80 of the PTC device (FIG. 11F). The end terminations 155, 156 are adjacent to and separated by the electrically non-conductive gaps 160, 170 in the first and second electrodes.

Figure 11G:
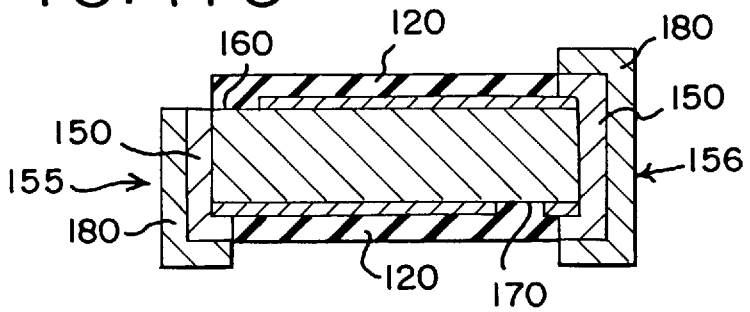

With reference to FIG. 11G, a second conductive layer 180 is applied to the first conductive layer 150. The second conductive layer 180 is preferably comprised of a solder composition (i.e., a tin/lead mixture) and can be applied by any conventional process, including electrolytic plating or solder dipping. The layer of solder permits the electrical devices 10 of the present invention to be easily connected to the conductive terminals of a PC board.

The final step in the process again involves dividing the strips at each break point into a plurality of electrical devices; e.g., punching, shearing or snapping.

Figure 12:
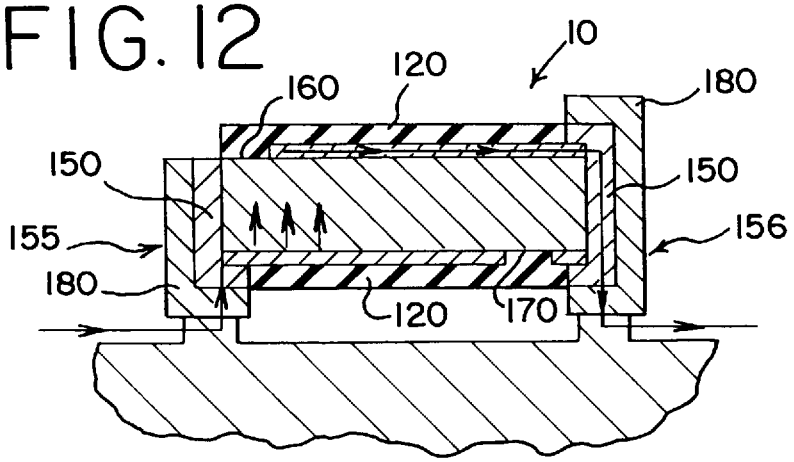
FIG. 12 is a cross-sectional view of a preferred embodiment of the device in FIGS. 11A–11G soldered to a PC board.

With reference to FIG. 12, the arrows indicate the flow of electrical current through the device 10. The end terminations 155, 156 allow current to flow from a conductive terminal of a PC board, up through the second 110 (or bottom) electrode. The current flows through the PTC element 20 to the first 100 (or top) electrode. Current then flows around the U-shaped end termination 156, exits the device, and continues to flow through the remainder of the circuit. While previous embodiments were symmetrically oriented, the device of this embodiment works most efficiently when attached to the circuit board in the manner illustrated in FIG. 12, or where the current enters at the U-shaped end termination 156 and exits via the L-shaped termination 155.

What is claimed is:

1. A method for manufacturing an electrical device comprising the steps of:

providing a laminar PTC sheet having a top and bottom surface, a first electrode formed on the top surface, and a second electrode formed on the bottom surface;

creating a plurality of strips in a regular pattern in the laminar PTC sheet;

forming a plurality of electrically non-conductive gaps in the first and second electrodes;

coating the strips in the laminar PTC sheet with an insulating layer;

removing portions of the insulating layer to expose opposed end portions of the PTC sheet and portions of the first and second electrodes;

applying a first conductive layer to the exposed end portions of the PTC sheet to form end terminations, the end terminations making electrical contact with the exposed portions of the first and second electrodes, respectively; and, dividing each strip in the laminar PTC sheet into a plurality of electrical devices.

2. The method of claim 1 further including the step of applying a second conductive layer on the first conductive layer.

3. The method of claim 1, wherein the step of forming the first and second electrodes on the top and bottom surfaces of the PTC sheet comprises laminating the PTC sheet between a pair of metal foils.

4. The method of claim 1, wherein the step of forming the first and second electrodes on the top and bottom surfaces of the PTC sheet comprises electroless plating.

5. The method of claim 1, wherein the step of forming the first and second electrodes on the top and bottom surfaces of the PTC sheet comprises electrolytic plating.

6. The method of claim 1, wherein the insulating layer is a material selected from the group consisting of photo resist, dielectric, ceramic and solder mask.

7. The method of claim 1, wherein the step of coating the strips in the laminar PTC sheet with an insulating layer comprises screen printing the insulating layer onto the strips.

8. The method of claim 1, wherein the step of coating the strips in the laminar PTC sheet with an insulating layer comprises spraying the insulating layer onto the strips.

9. The method of claim 1, wherein the first conductive layer is a metal selected from the group consisting of copper, tin, nickel, silver, gold and alloys thereof.

10. The method of claim 1, wherein the step of forming the plurality of electrically non-conductive gaps comprises the further steps of:

applying a masking material to the first and second electrodes, leaving portions of the electrodes unmasked; and, etching away the unmasked portions of the first and second electrodes.

11. The method of claim 10 wherein the step of forming the plurality of electrically non-conductive gaps includes etching with an acid solution.

12. The method of claim 1, wherein the second conductive layer comprises solder and is applied to the first conductive layer by electrolytic plating or solder dipping.

13. The method of claim 1, wherein the strips created in the laminar PTC sheet have a width, W, less than 0.20 inch.

14. The method of claim 1, further including the step of dividing each strip into a plurality of electrical devices comprises applying pressure to a plurality of break points.

15. The method of claim 1, wherein each electrical device formed has an area of less than 0.060 $inch^2$.

16. A method for manufacturing an electrical device comprising the steps of:

providing a laminar resistive element having first and second surfaces and opposed end portions;

forming a first electrode on the first surface of the resistive element;

forming a second electrode on the second surface of the resistive element;

creating an electrically non-conductive gap in each of the first and the second electrodes;

applying an insulating layer to the first and second electrodes and the opposed end portions of the laminar resistive element;

curing the insulating layer on portions of the first and second electrodes;

removing the insulating layer from the end portions of the laminar resistive element and from the uncured portions of the first and second electrodes; and, applying a first conductive layer to the exposed end portions of the laminar resistive element to form first and second end terminations, the first end termination making electrical contact with the first electrode and the second end termination making electrical contact with the second electrode; and, applying a second conductive layer to the first conductive layer.

17. The method of claim 16, wherein the step of curing the insulating layer further includes masking portions of the top and bottom insulating layer, while leaving the end portions of the insulating layer unmasked.

18. The method of claim 17 wherein the step of curing the insulating layer further includes treating the unmasked portions of the insulating layers with an ultraviolet light.

19. The method of claim 16, wherein the resistive element exhibits PTC behavior.

20. The method of claim 19, wherein the resistive element comprises a polymer component and a conductive filler component.

21. The method of claim 20, wherein the polymer component comprises polyethylene.

22. The method of claim 20, wherein the polymer component comprises polyethylene and maleic anhydride.

23. The method of claim 16, wherein the second conductive layer comprises solder.

24. The method of claim 16, wherein the first and second electrode comprise nickel.

25. A method for manufacturing an electrical device comprising the steps of:

providing a laminar conductive sheet having a first and second surface and opposed end portions, a first electrode formed on the first surface, and a second electrode formed on the second surface;

creating a plurality of strips in the laminar conductive sheet;

forming a plurality of electrically non-conductive gaps in the first and second electrodes;

coating the strips in the laminar conductive sheet with an insulating layer;

removing portions of the insulating layer to expose the opposed end portions of the laminar conductive sheet and to expose portions of the first and second electrodes;

applying a first conductive layer to the exposed end portions of the conductive sheet and to the exposed portions of the first and second electrodes; and, dividing each strip in the laminar conductive sheet into a plurality of electrical devices.

26. The method of claim 25, wherein the laminar conductive sheet exhibits PTC behavior.

27. The method of claim 25, wherein a plurality of break points are formed on the top and bottom surface of each strip.

28. The method of claim 25, wherein a second conductive layer is formed on the first conductive layer.

29. The method of claim 25, wherein the step of removing the insulating layer to expose the opposed end portions of the laminar conductive sheet includes:

covering a portion of the insulating layer overlapping the electrodes on the top and bottom surfaces with a masking material, while leaving the insulating layer on end portions of the conductive sheet unmasked;

treating the unmasked portions of the insulating layer with an ultraviolet light; and, removing the masked portions of the insulating layer and exposing the end portions of the conductive sheet.

30. A method for manufacturing an electrical device comprising the steps of:

providing a laminar resistive element having first and second surfaces and first and second end portions;

forming a first electrode on the first surface of the resistive element;

forming a second electrode on the second surface of the resistive element;

forming at least one electrically non-conductive gap in the first electrode adjacent to the first end portion of the laminar resistive element;

forming at least a second electrically non-conductive gap in the second electrode and spaced inwardly from the second end portion;

applying an insulating layer to the first and second electrodes and opposed end portions of the laminar resistive element;

curing the insulating layer on portions of the first and second electrodes;

removing the insulating layer to expose the end portions of the laminar resistive element and to expose portions of the first and second electrodes; and, applying a first conductive layer to the exposed end portions of the laminar resistive element and to the exposed portions of the first and second electrodes to form first and second end terminations; and, applying a second conductive layer to the first conductive layer.

31. The method of claim 30, wherein the step of removing the insulating layer to expose the opposed end portions of the laminar conductive sheet includes:

covering a portion of the insulating layer overlapping the electrodes on the top and bottom surfaces with a masking material, while leaving an unmasked L-shaped insulating layer on the first end portion of the conductive sheet;

covering a portion of the insulating layer overlapping the electrodes on the top and bottom surfaces with a masking material, while leaving an unmasked U-shaped insulating layer on the second end portion of the conductive sheet;

treating the unmasked portions of the insulating layer with an ultraviolet light; and, removing the masked portions of the insulating layer and exposing the end portions of the conductive sheet.

* * * * *